US007237538B2

(12) United States Patent
Perruchot et al.

(10) Patent No.: US 7,237,538 B2
(45) Date of Patent: Jul. 3, 2007

(54) MODULAR FUEL DELIVERY ASSEMBLY

(75) Inventors: Pascal Perruchot, Châlons en Champagne (FR); Robert Renaud, Châlons en Champagne (FR)

(73) Assignee: TI Automotive Fuel Systems SAS, Châlons en Champagne (FR)

( * ) Notice: Subject to any disclaimer, the term of this patent is extended or adjusted under 35 U.S.C. 154(b) by 0 days.

(21) Appl. No.: 11/222,522

(22) Filed: Sep. 9, 2005

(65) Prior Publication Data

US 2007/0056567 A1 Mar. 15, 2007

(51) Int. Cl.
*F02M 37/04* (2006.01)
*F02M 37/02* (2006.01)

(52) U.S. Cl. ..... 123/509

(58) Field of Classification Search ..... 123/509, 123/510, 514, 516; 137/572, 571, 574, 576; 417/423.15, 360, 361, 313
See application file for complete search history.

(56) References Cited

U.S. PATENT DOCUMENTS

| | | | | | |
|---|---|---|---|---|---|
| 4,569,637 | A * | 2/1986 | Tuckey | 417/360 |
| 4,694,857 | A * | 9/1987 | Harris | 137/565.24 |
| 5,056,492 | A * | 10/1991 | Banse | 123/509 |
| 5,445,503 | A * | 8/1995 | Kmiec et al. | 417/360 |
| 5,642,719 | A * | 7/1997 | Brown | 123/509 |
| 5,762,049 | A * | 6/1998 | Jones et al. | 123/514 |
| 6,014,957 | A * | 1/2000 | Robinson | 123/509 |
| 6,206,037 | B1 * | 3/2001 | Murakoshi et al. | 137/565.34 |
| 6,293,770 | B1 * | 9/2001 | Matsumoto et al. | 417/361 |
| 7,108,487 | B2 * | 9/2006 | Koba et al. | 417/360 |

* cited by examiner

*Primary Examiner*—Mahmoud Gimie
(74) *Attorney, Agent, or Firm*—Reising, Ethington, Barnes, Kisselle, P.C.

(57) ABSTRACT

A modular fuel delivery assembly for a fuel tank of a vehicle includes a mounting flange, a common support member adjustably engaged with the mounting flange, and a plurality of accessories attached to the common support member.

17 Claims, 6 Drawing Sheets

MODULAR FUEL DELIVERY ASSEMBLY

FIELD OF THE INVENTION

This invention relates generally to fuel delivery systems for vehicles and, more particularly to a fuel delivery assembly disposed in a fuel tank of a vehicle fuel delivery system.

BACKGROUND OF THE INVENTION

Typical automotive fuel systems have a fuel delivery assembly mounted within and received through an opening in an upper wall of a fuel tank of a vehicle. A typical fuel delivery assembly may include a mounting flange for mounting to the upper wall of the fuel tank, multiple spaced-apart posts fixed to the mounting flange, and a reservoir housing connected to the mounting flange by the posts. The typical fuel delivery assembly may also include various conduits and wires extending through the mounting flange and terminating in connections to various components of the assembly, a fuel level sender mounted to the reservoir housing to measure the level of fuel in the fuel tank, and a fuel pump carried by the reservoir housing and having an inlet relatively adjacent a lower wall of the fuel tank to draw fuel from the fuel tank and deliver the fuel under pressure to an engine of the vehicle.

Currently, many fuel pump assemblies must be specifically designed to suitably match the height of the fuel tanks in which the assemblies are mounted. This is because every vehicle type requires a fuel tank of unique height, wherein the distance between the lower and upper walls of the fuel tank may be significantly different from one tank design to another or from one tank chamber to another in the case of saddle-type fuel tanks with dual chambers. But custom designing many different fuel pump assemblies may not be the most cost effective approach.

SUMMARY OF THE INVENTION

A modular fuel delivery assembly for a fuel tank of a vehicle includes a mounting flange that is preferably configured for mounting within an opening of the fuel tank. The assembly further includes a common support member adjustably engaged with the mounting flange, and a plurality of accessories attached to the common support member.

At least some of the objects, features and advantages that may be achieved by at least certain embodiments of the invention include providing a modular fuel delivery assembly, that includes a common support member of selectable length and to which various modular accessories may be mounted; modular accessories that may be standardized and used in a variety of fuel delivery assemblies for different fuel tanks and vehicles; standardized attachment between the modular accessories and the common support member; is adaptable for use with fuel tanks of different heights or fuel tank chambers of different heights; adjustable attachment between the common support member and a mounting flange of the assembly to ensure location of an accessory against a bottom of the fuel tank; is of relatively simple design and economical manufacture and assembly, rugged, durable, reliable and in service has a long useful life.

Of course, other objects, features and advantages will be apparent in view of this disclosure to those skilled in the art. Various other fuel delivery assemblies embodying the invention may achieve more or less than the noted objects, features or advantages.

BRIEF DESCRIPTION OF THE DRAWINGS

These and other objects, features and advantages of the present invention will be apparent from the following detailed description of the preferred embodiment(s) and best mode, appended claims, and accompanying drawings in which:

DETAILED DESCRIPTION OF THE PREFERRED EMBODIMENTS

Figure 1:
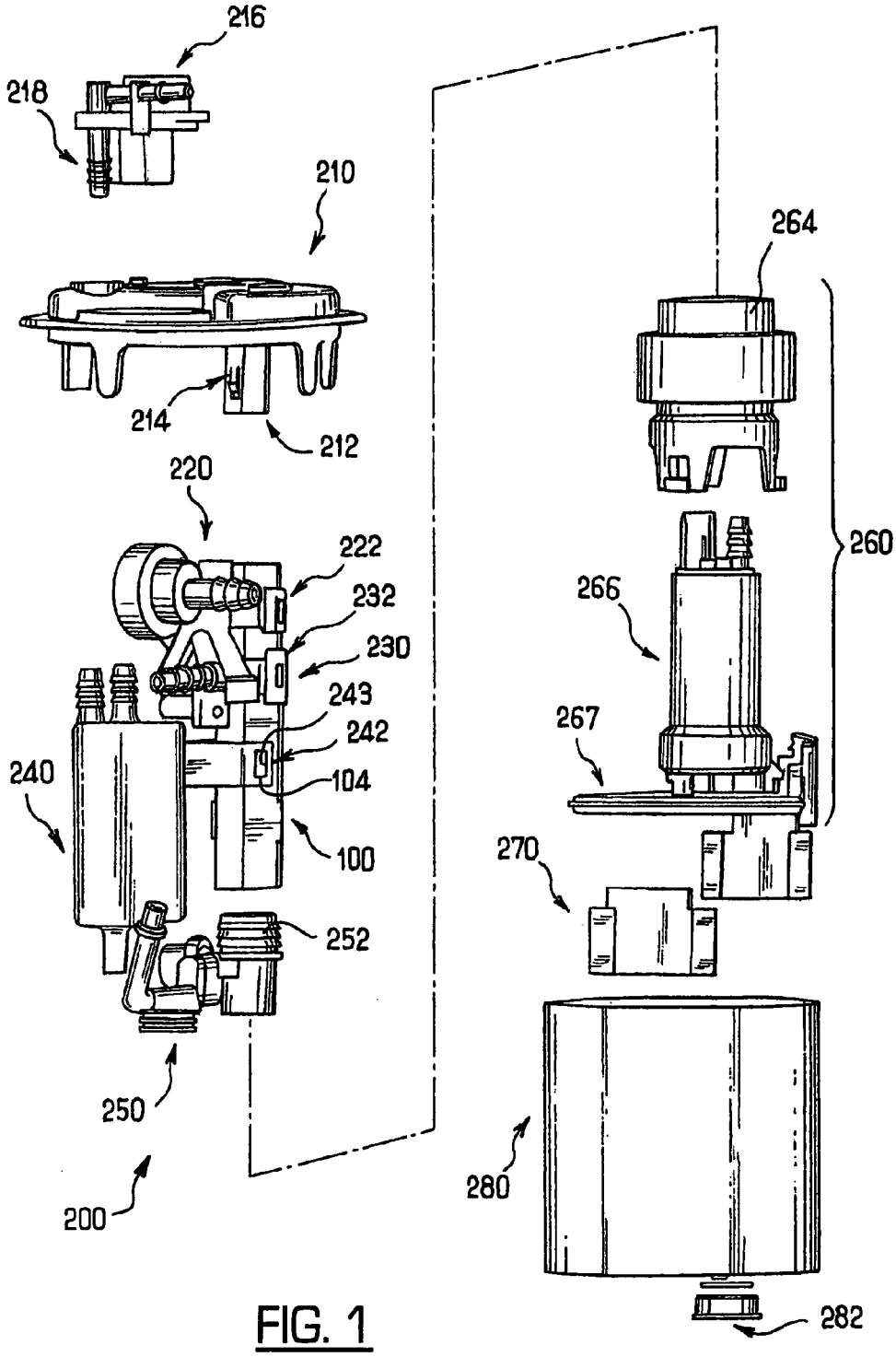
FIG. 1 is an exploded perspective view of a presently preferred embodiment of a fuel delivery assembly.

Referring in more detail to the drawings, FIG. 1 illustrates a modular modular fuel delivery assembly 200 having a common support member 100, such as a post, mast, or the like, that carries various accessories including a base or mounting flange 210 arranged for mounting within and through an opening in an upper wall of a fuel tank of a vehicle (not shown). Other accessories of the assembly 200 may include a pressure-regulating assembly 220 to regulate fuel pressure, a distributor 230 to distribute fuel, a filter 240 such as a downstream or pressure-side filter, a venturi jet pump assembly 250, an electric fuel pump assembly 260 to pump fuel, a support 270 for mounting a fuel level sensor (not shown) to the mast 100, and a fuel reservoir 280 for holding a quantity of fuel.

The mast 100 preferably extends in a generally vertical direction, but it is contemplated that the mast 100 could extend in any suitable direction including a non-vertical direction. The mast 100 is preferably composed of a plastic or metal material, and is preferably formed in a generally tubular shape of hollow cross section, non-circular in revolution, and substantially constant over its length. For example, the mast 100 may be of polygonal cross section, such as hexagonal cross section as shown. The polygonal, or at least non-circular cross-sectional shape of the support mast 100 is preferred to provide angular fixation of the various accessories 210–280 carried by the mast 100 and, thus, accurate positioning of the various accessories 210–280 and prevention of relative rotation between the mast 100 and the various accessories 210–280.

The mast 100 preferably includes a plurality of longitudinally elongate slots 102 adjacent its upper end. Such slots 102 can be provided on one or more of the faces of the mast 100. The slots 102 are configured to receive lateral projections 214 formed on a pillar or post 212 attached to the lower face of the mounting flange 210.

The mounting flange 210 is intended to be attached to a fuel tank (not shown), and preferably to an upper wall (not shown) of the fuel tank. The general structure of a mounting flange is well known to those of ordinary skill in the art. It can be seen that the mounting flange 210 preferably carries, on its upper surface, an electrical connector 216 to make connections with electrical accessories, such as an electric pump 266 and a fuel level sensor (not shown), as well as at least one tube 218 to convey to the engine (not shown) fuel delivered by the electric fuel pump 266.

The post 212 of the mounting flange 210 is engaged to the mast 100, preferably inserted within the mast 100. Consequently, it preferably has an external profile that is non-circular and complementary to the internal profile of the mast 100, such as hexagonal, to prevent relative rotation therebetween but permit axial adjustment therebetween. Those of ordinary skill in the art will understand that the assembly of the projections 214 into the slots 102 allows relative sliding or adjustment between the mounting flange 210 and the mast 100 in a direction that is substantially parallel the axis of the mast 100. Accordingly, this axial adjustment enables a lower end of the mast 100, or an accessory mounted thereto, to be located and yieldably biased, such as by a spring, against a bottom wall of the fuel tank (not shown), in order to provide reliable measurement of fuel in relation to the bottom and to assure that a fuel pump intake is located adjacent the fuel tank bottom for suitable fuel pumping.

Those of ordinary skill in the art will recognize that the connection between the mounting flange 210 and the mast 100 is not limited to the above-mentioned arrangements. For example, in another configuration the post 212 of the mounting flange 210 could instead be engaged on the outside of the mast 100 and not inside latter. In other words, the mast 100 could instead be fit within the post 212. According to yet another modification, one could provide longitudinal slots in the post 212 fixed to the mounting flange 210 and projections on the mast 100.

In any case, those of ordinary skill in the art will recognize that the mast 100 and post 212 arrangement makes the modular fuel delivery assembly 200 adjustable and amenable for use with fuel tanks wherein the distance between the lower and upper walls of the fuel tanks may be significantly different from one tank design to another or from one tank chamber to another in the case of saddle-type fuel tanks with dual chambers. In other words, when designing a modular fuel delivery assembly for use with multiple fuel tanks of different heights, one chooses masts 100 of different lengths and/or flanges 210 which include posts 212 of different lengths wherein the lengths of the masts 100 and/or posts 212 correspond to the height of the particular fuel tank or fuel tank chambers.

The various other accessories 220, 230, 240, 250, 260, 270, 280 are preferably commonly attached to the sides or faces of the mast 100 by any appropriate means, such as by welding, gluing, clipping, sockets, sliding connections, snap fasteners and the like. As can be seen with the pressure-regulating assembly 220, the distributor 230, the filter 240, and the electric fuel pump assembly 260, at least some of these accessories are secured to the mast 100 using attachment means which may include one or more brackets 222, 232, 242, 262 suitable for being placed alongside and attached to the mast 100. More specifically, some of the accessories may be attached to a support yoke defined by two of such brackets 222, 232, 242, 262 suitable for being secured respectively to different faces of the mast 100, and typically to two diametrically opposite faces of the mast 100.

Figure 3:
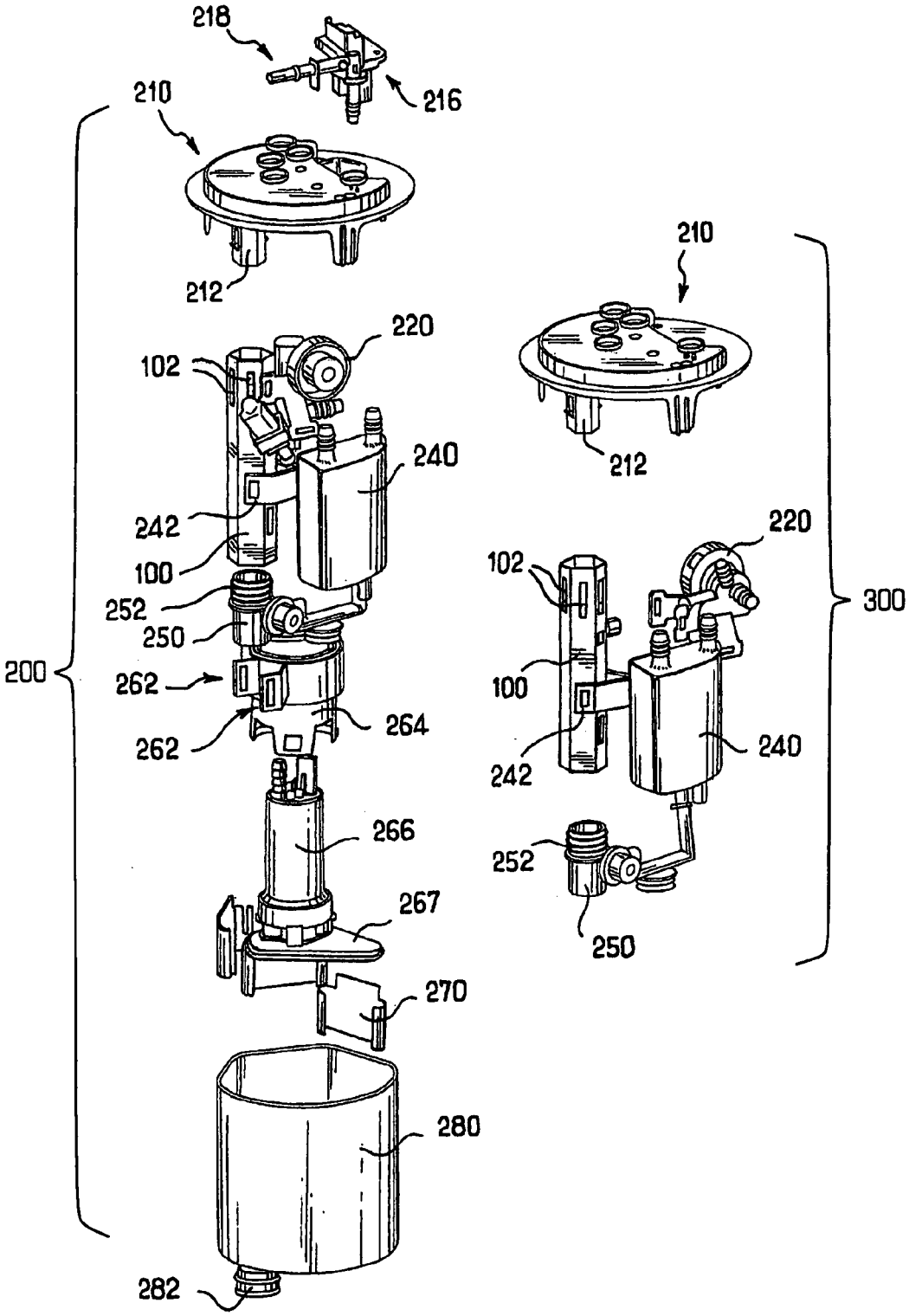
FIG. 3 is an exploded perspective view of the fuel pump assemblies of FIGS. 1 and 2, side by side.
Figure 4:
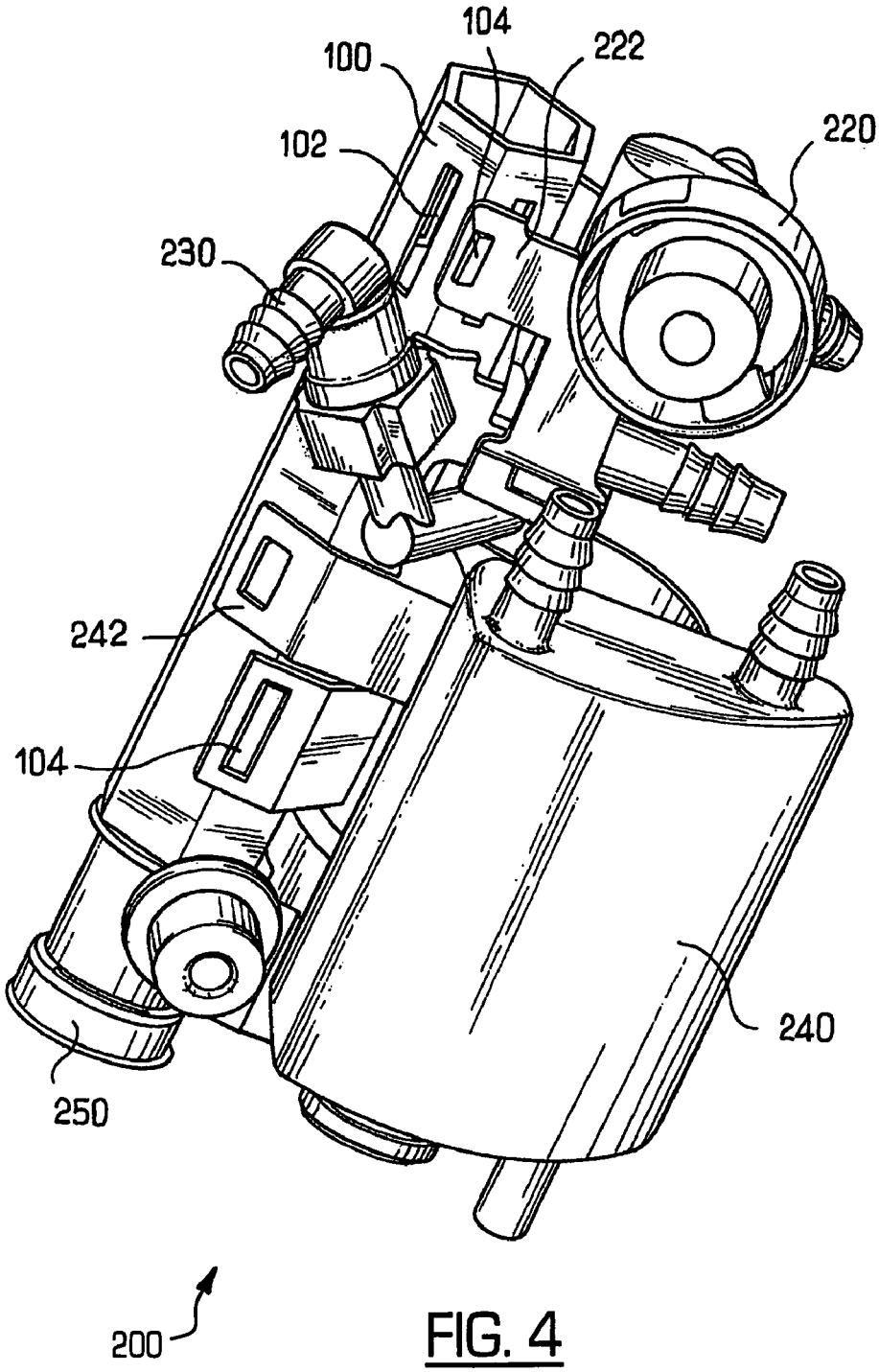
FIG. 4 is a perspective view of a presently preferred embodiment of a support mast assembly including a support mast and various accessories for use with the fuel delivery assembly of FIG. 1.
Figure 5:
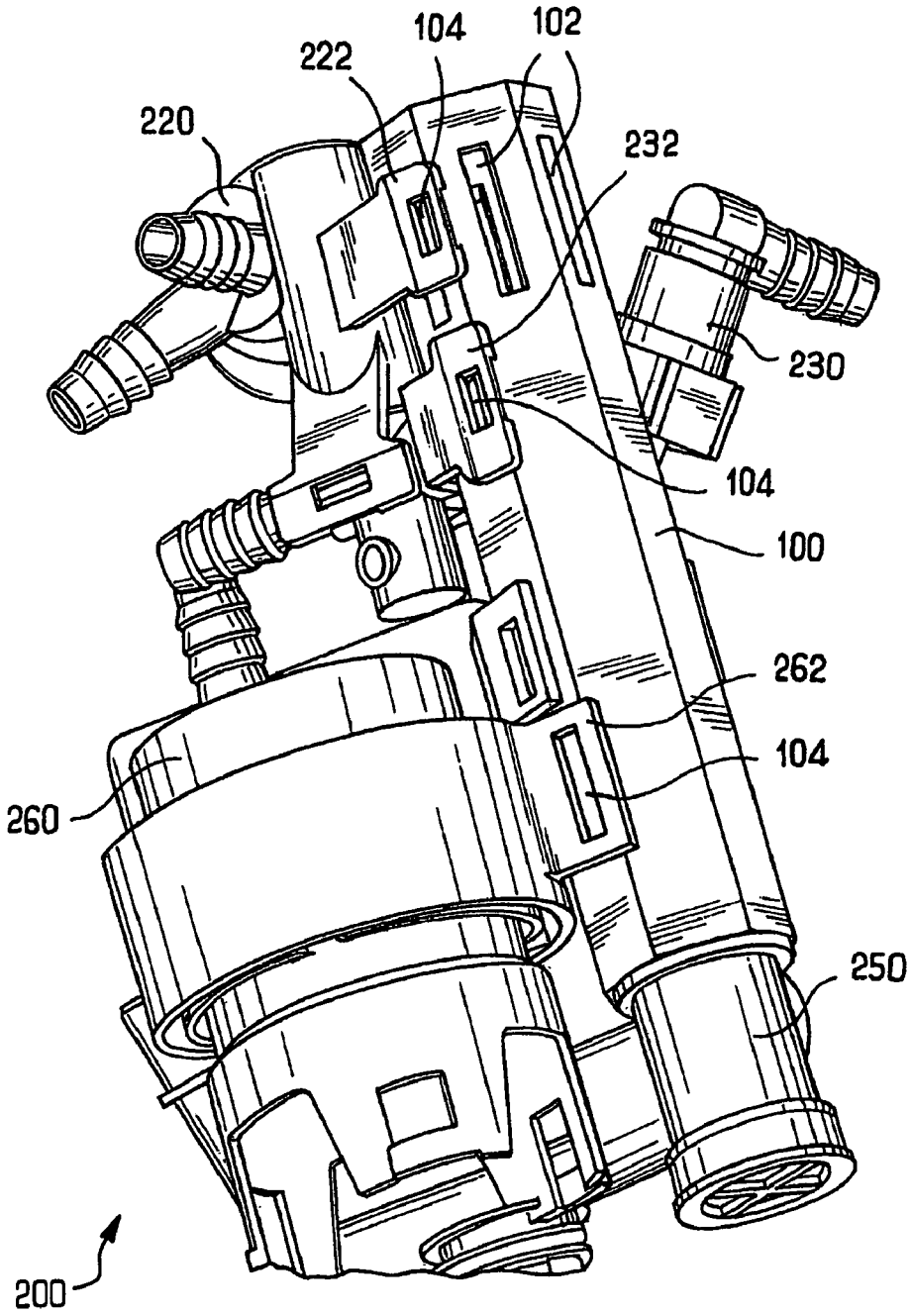
FIG. 5 is another perspective view of the support mast assembly of FIG. 4, taken from a different angle.
Figure 6:
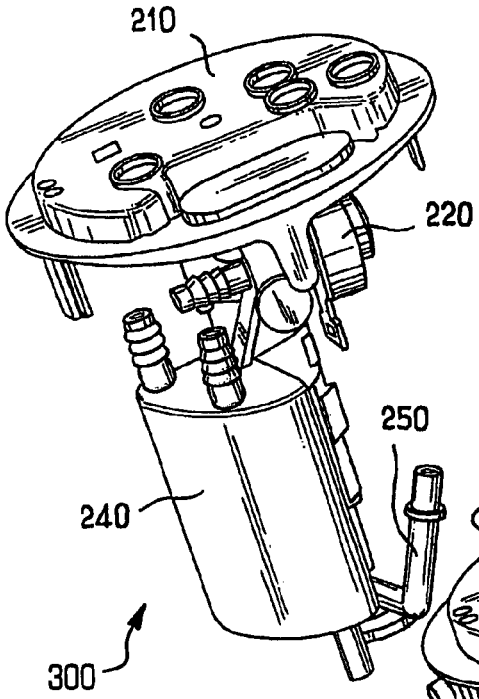
FIG. 6 is an assembled perspective view of the fuel delivery assembly of FIG. 2.
Figure 7:
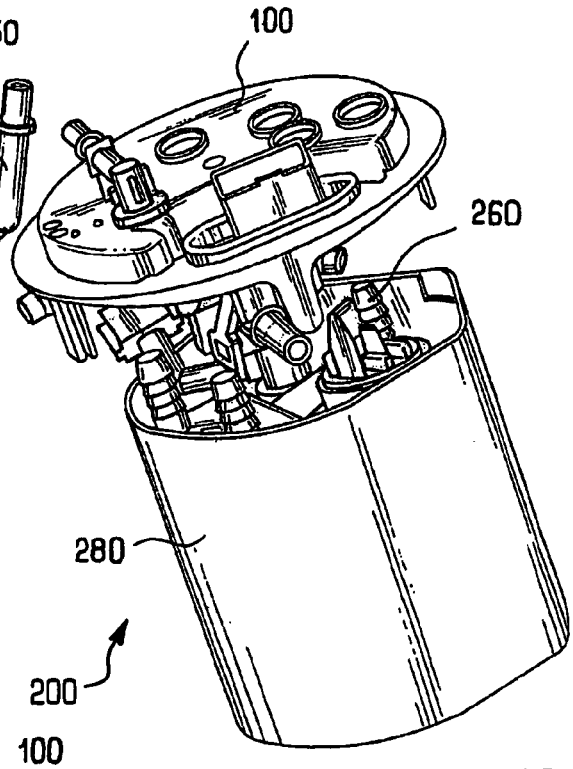
FIG. 7 is an assembled perspective view of the fuel pump assembly of FIG. 1.

FIG. 3 better illustrates such a yoke, which includes two brackets 262 for the electric fuel pump assembly 260. Where appropriate, these brackets 222, 232, 242, 262 can include a slot, while the mast 100 includes a complementary projection intended to enter into the slot in order to attach the accessory by clipping to the mast 100 and to precisely position the accessory relative to the support mast. FIG. 1 illustrates such a slot 243, which is formed in the attachment bracket 242, and a complementary projection 104, which is formed on the mast 100. In order to simplify the drawing figures, the other slots and projections have not been shown. Those of ordinary skill in the art will recognize that, where appropriate, a projection can instead be provided on the brackets 222, 232, 242, 262 of the accessory and, conversely, a complementary slot can be provided in the mast 100.

The pressure-regulating assembly 220 functions to limit the pressure of the fuel conveyed from the fuel tank to the engine (not shown). The pressure-regulating assembly 220 can be of any suitable type known to those of ordinary skill in the art. For example, the pressure regulating assembly 220 may be formed from a diaphragm type or unit that includes a membrane compressed elastically by a spring against an output orifice. Accordingly, when the pressure of the fuel is less than a threshold predetermined by the spring force imposed on the membrane, the membrane remains in contact with the output orifice to close it off. On the contrary, when the pressure of the fuel is greater than this predetermined threshold, the membrane is forced back from the output orifice to allow a return of excess fuel to the reserve tank 280 or the fuel tank for example.

The distributor 230 functions to provide fluid communication between some or all of the accessories, such as between the output of the electric fuel pump assembly 260, the regulator 220, the filter 240, and the venturi jet pump 250.

The filter 240 functions to filter the fuel before it is conveyed to the engine, and may be positioned upstream or downstream of the pump.

The venturi jet pump assembly 250 transfers fuel from a first location, such as the general volume of the fuel tank, to a second location, such as the reserve tank 280. Those of ordinary skill in the art are familiar with venturi jet pump assemblies. The assembly 250 operates using a flow, such as a return flow of fuel from the engine coming from a take-off point at the output of the filter or from an output stage of the fuel pump, which is injected through a nozzle that discharges into a throat which results in the creation of a vacuum capable of drawing fuel from the first location. The assembly 250 may be attached to the mast 100 such as by a ferrule 252 attached to the assembly 250 and suitable to be engaged axially in the lower end of the mast 100.

The electric fuel pump assembly 260 pumps fuel for transfer from the reservoir to the engine. It can be formed from any suitable configuration known to those of ordinary skill in the art, but may include a support 264 carrying the aforementioned brackets 262, and an electric pump 266 fitted at the input to a filter 267 such as an upstream or suction-side filter.

In order to simplify the drawing figures, the fuel level sensor that may be carried by the support 270 has not been shown. The fuel level sensor can be formed from any structures known to those of ordinary skill in the art that is capable of measuring the level of fuel present in the fuel tank, and of sending the information for use by a vehicle occupant.

The reserve tank 280 holds a predetermined quantity of fuel at the inlet to the pump 266, irrespective of acceleration or incline of the vehicle, in order to avoid any fuel starvation or cavitation of the pump. The structure of reserve tanks is well known to those of ordinary skill in the art. It can be seen that the reserve tank 280 is preferably equipped with a check valve 282 in the inlet to the reserve tank. The reserve tank 280 may be secured to the mast 100 by any suitable means, such as suitable structure to be engaged in the lower end of the mast 100 or the ferrule 252. It is possible to attach several accessories to the mast 100 by telescopically slotting a variety of accessory supports into each other. The reserve tank 280 may also be attached to the mast 100 by means of brackets inside the reserve tank 280, similar to those described earlier.

Figure 2:
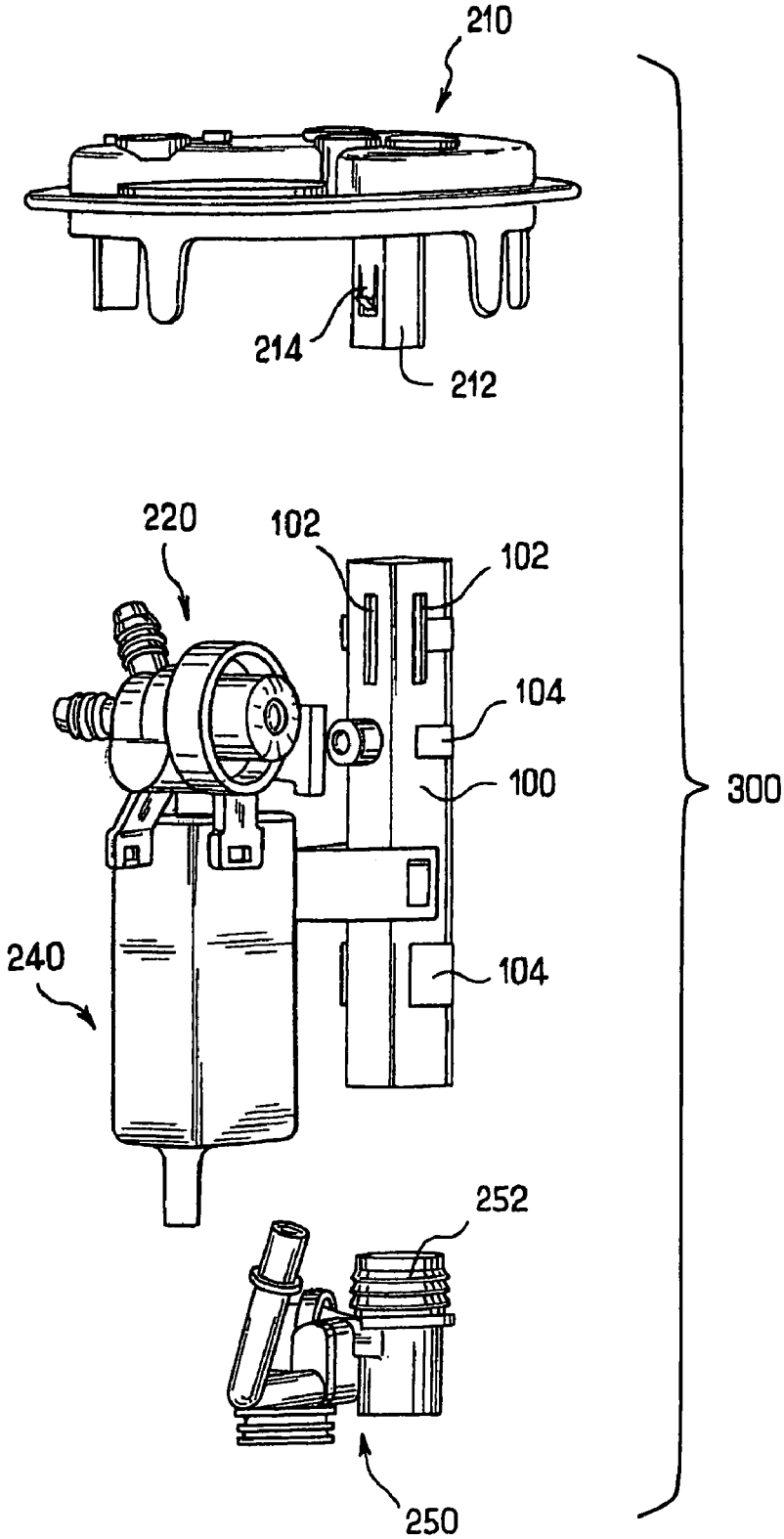
FIG. 2 is an exploded perspective view of another presently preferred embodiment of a fuel delivery assembly similar to that shown in FIG. 1 and for use with a saddle-type fuel tank having dual fuel chambers.

FIG. 2 illustrates another presently preferred embodiment of a modular modular fuel delivery assembly 300 for use with a saddle-type fuel tank with dual fuel chambers or with dual fuel tanks. This embodiment is similar in many respects to the embodiment of FIG. 1 and like numerals between the embodiments generally designate like or corresponding elements throughout the several views of the drawing figures. Additionally, the description of the common subject matter may generally not be repeated here.

The modular fuel delivery assembly 300 of FIG. 2 is preferably used in conjunction with the modular fuel delivery assembly 200 shown in FIG. 1 for a saddle-type fuel tank with dual chambers. In this case, the two fuel pump assemblies 200, 300 illustrated in FIGS. 1 and 2 are positioned respectively in the two chambers of the saddle-type fuel tank in order to pump the fuel from one chamber to another and to the vehicle engine. The modular fuel delivery assembly 300 illustrated in FIG. 2 is similar to that of FIG. 1 and includes shared components such as a support mast 100, a mounting flange 210, and one or more accessories such as a pressure-regulating assembly 220, a filter 240, and a venturi jet pump 250 carried by the mast 100 preferably using the same attachment arrangements as that described earlier with reference to FIG. 1. Those of ordinary skill in the art will understand any suitable accessories may be secured to the mast 100, and in particular the pump, regulator, filter and reserve tank, to comply with given specifications established for a particular fuel tank and fuel delivery assembly, without having to change the general architecture of the fuel delivery assemblies 200, 300 or the assembly method thereof. Accordingly, the fuel delivery assemblies 200, 300 are modular, meaning that the design allows it to accommodate different accessories, whose number and form can vary in accordance with any given specifications of a fuel delivery system producer or vehicle manufacturer. This modularity is made possible not only by the standardization of the various components themselves, but also by the standardization of their attachment which, irrespective of the component or accessory, allows them to be commonly fixed to the mast 100, which constitutes a common or standard part for all generations of product.

Those of ordinary skill in the art will recognize that some accessories or components, as well as their method of attachment, may be symmetrical in relation to the mast 100. Such accessories can, therefore, be fixed in a reverse direction or position in order to allow different configurations.

Figure 8:
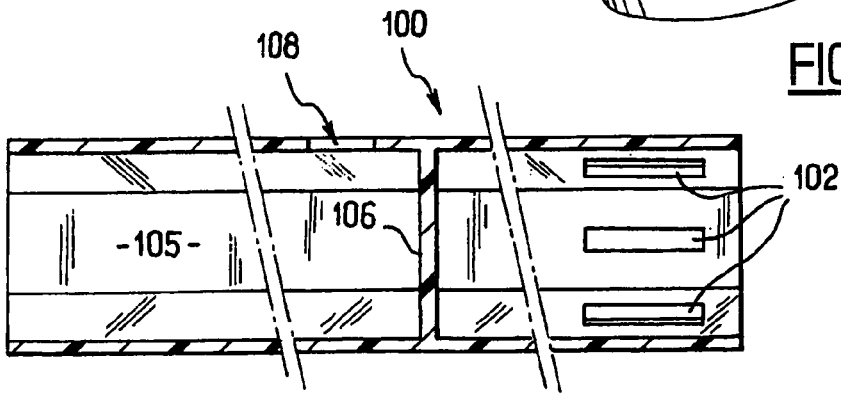
FIG. 8 is a longitudinal cross-sectional view of the presently preferred support mast of FIG. 4.

Referring now to FIG. 8, where appropriate, the mast 100 may be a conduit that carries fuel displaced by the pump. In other words, the internal volume of the mast 100 is split into two sections by a sealed transverse partition 106. This partition 106 is used to isolate a lower section 105 of the mast 100 from the slots 102 provided in the upper section of the mast 100, in order to prevent any leakage of fuel introduced into the lower section 105 via the slots 102. However, the mast 100 can include one or more transversely extending orifices 108 in communication with the lower section 105 and used to provide a fluid connection between the inside of the lower section 105 of the mast 100 and an accessory, such as the distributor 230 or the venturi jet pump assembly 250. Such accessories can thus be in fluid communication, by means of the mast 100, with one or more other accessories connected to another orifice opening into the lower section 105 of the mast 100. The lower section 105 of the mast 100 located under the partition 106 can have a section that is different from the upper part of the mast 100, which slidingly receives the post 212 of the mounting flange 210.

Those of ordinary skill in the art will understand that the mast 100 may serve as a reference for the assembly process of the complete modular fuel delivery assembly 200, whether assembled manually, automatically or by robotic systems. The mast 100 and the various accessories 210 to 280 can be made from any appropriate material, such as those based on a plastic material or a metal. Preferably, the mast 100 and at least the part of the accessories 220 to 280, intended to be brought into contact with this mast 100, are made from a plastic material. This arrangement allows attachment of the accessories by welding. Preferably however, it is preferable to ensure that the post 212 of the mounting flange 210 and the mast 100 are not made simultaneously from a plastic material. In this context, it is possible, for example, to create the post 212 in metal and the mast 100 in a plastic material, or inversely to create the post 212 in a plastic material and the mast 100 in metal.

As used in this specification and claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components, elements, or items. Moreover, directional words such as top, bottom, upper, lower, radial, circumferential, axial, lateral, longitudinal, vertical, horizontal, and the like are employed by way of description and not limitation. Other terms are to be construed using their broadest reasonable meaning unless they are used in a context that requires a different interpretation. When introducing elements of the present invention or the embodiments thereof, the articles "a," "an," "the," and "said" are intended to mean that there are one or more of the elements.

It is to be understood that the invention is not limited to the particular exemplary embodiments disclosed herein, but rather is defined by the claims below. In other words, the statements contained in the foregoing description relate to particular exemplary embodiments and are not to be construed as limitations on the scope of the invention as claimed below or on the definition of terms used in the claims, except where a term or phrase is expressly defined above.

Although the present invention has been disclosed in conjunction with a limited number of presently preferred exemplary embodiments, many others are possible and it is not intended herein to mention all of the possible equivalent forms and ramifications of the present invention. Other modifications, variations, forms, ramifications, substitutions, and/or equivalents will become apparent or readily suggest themselves to persons of ordinary skill in the art in view of the foregoing description. In other words, the teachings of the present invention encompass many reasonable substitutions or equivalents of limitations recited in the following claims. As just one example, the disclosed structure, materials, sizes, shapes, and the like could be readily modified or substituted with other similar structure, materials, sizes, shapes, and the like. In another example, the invention has been disclosed in conjunction with a saddle-type fuel tank having dual chambers. However, additional applications are contemplated wherein the present invention can be applied to any type of fuel, diesel or gasoline, and to any type of vehicle application, whether equipped with one or more single or multiple chamber fuel tank(s), and whether or not it has one or more of the specific accessories discussed herein, and can be provided without departing from the disclosure. Indeed, the present invention is intended to embrace all such forms, ramifications, modifications, variations, substitutions, and/or equivalents as fall within the spirit and broad scope of the following claims.

What is claimed is:

1. A modular fuel delivery assembly for a fuel tank of a vehicle, comprising:

a mounting flange having a single post;

a single mast adjustably engaged with the mounting flange, wherein the mast and post are slidingly fit one inside of the other and are of corresponding non-circular cross-sectional shape to prevent relative rotation therebetween; and a plurality of accessories attached to the mast.

2. The modular fuel delivery assembly of claim 1, wherein the mast is polygonal in cross section.

3. The modular fuel delivery assembly of claim 1, wherein the mast is formed from a longitudinally extending hollow tube including a transversely extending partition defining two sections on either side thereof.

4. The modular fuel delivery assembly of claim 3, wherein the mast is a conduit for conveying fuel therethrough.

5. The modular fuel delivery assembly of claim 1, wherein the mounting flange post includes a projection and the mast includes an upper end and a longitudinal slot adjacent the upper end for receiving the projection of the mounting flange post.

6. The modular fuel delivery assembly of claim 1, wherein the plurality of accessories includes at least two of a pressure-regulating assembly, a distributor, a filter, a venturi jet pump assembly, a fuel pump assembly, a fuel-level sensor support, or a fuel reservoir.

7. The modular fuel delivery assembly of claim 1, wherein the plurality of accessories is secured to the mast by means that are chosen from the group consisting of welding, gluing, clipping, sockets, or sliding connections.

8. The modular fuel delivery assembly of claim 1, wherein the mast has at least one mounting face and the plurality of accessories is secured to the mast by brackets suitable for being placed alongside and attached to the at least one mounting face of the mast.

9. The modular fuel delivery assembly of claim 8, wherein the at least one of the plurality of accessories is secured to the mast by a support yoke including two brackets suitable for being secured respectively to different mounting faces of the at least one mounting face of the mast.

10. The modular fuel delivery assembly of claim 8, wherein the at least one bracket includes at least one of a slot or projection, and the mast includes at least one of a complementary projection or complementary slot to cooperate with the at least one of a slot or projection of the at least one bracket to attach the at least one accessory onto the mast.

11. The modular fuel delivery assembly of claim 1, wherein the at least one of the plurality of accessories includes a ferrule suitable for being engaged axially in an end of the mast.

12. The modular fuel delivery assembly of claim 1, wherein the plurality of accessories is slotted telescopically into one another.

13. A method of assembling a modular fuel delivery assembly for a fuel tank of a vehicle, comprising:

selecting a plurality of accessories;

attaching the plurality of accessories to a common support member; and engaging the common support member to a post of a mounting flange in an axially adjustable manner, wherein the common support member and post are slidingly fit one inside of the other and are of corresponding non-circular cross-sectional shape to prevent relative rotation therebetween.

14. A modular fuel delivery assembly for a fuel tank of a vehicle, comprising:

a mounting flange including a post;

a common support member adjustably engaged to the mounting flange, wherein the common support member and post are slidingly fit one inside of the other and are of corresponding non-circular cross-sectional shape to prevent relative rotation therebetween; and a plurality of accessories attached to the common support member.

15. The modular fuel delivery assembly of claim 14, wherein the support member is polygonal in cross section.

16. The modular fuel delivery assembly of claim 14, wherein the support member is formed from a longitudinally extending hollow tube including a transversely extending partition defining two sections on either side thereof.

17. The modular fuel delivery assembly of claim 16, wherein the support member is a conduit for conveying fuel therethrough.

* * * * *